US007597854B1

(12) United States Patent
Reynolds

(10) Patent No.: US 7,597,854 B1
(45) Date of Patent: Oct. 6, 2009

(54) PIPETTE GUIDE

(75) Inventor: Cedric S. Reynolds, Greensboro, NC (US)

(73) Assignee: Stovall Life Science, Inc., Greensboro, NC (US)

( * ) Notice: Subject to any disclaimer, the term of this patent is extended or adjusted under 35 U.S.C. 154(b) by 271 days.

(21) Appl. No.: 11/724,510

(22) Filed: Mar. 15, 2007

(51) Int. Cl.
*B01L 3/02* (2006.01)

(52) U.S. Cl. ..... 422/104; 422/100; 73/1.73; 73/1.74; 73/863.32; 73/864.01; 435/288.4; 435/305.2; 435/305.3; 435/305.4

(58) Field of Classification Search ..... 422/99, 422/100, 922–929; 73/1.73, 1.74, 863.32, 73/864.01
See application file for complete search history.

(56) References Cited

U.S. PATENT DOCUMENTS 3,168,124 A * 2/1965 Lenkey ..... 141/284
3,687,175 A * 8/1972 Babey ..... 141/59
3,843,053 A * 10/1974 Thoden ..... 239/11
4,004,548 A * 1/1977 Smola et al. ..... 118/58
4,265,855 A * 5/1981 Mandle et al. ..... 422/65
4,827,780 A * 5/1989 Sarrine et al. ..... 73/864.21
4,919,894 A * 4/1990 Daniel ..... 422/104
4,925,629 A * 5/1990 Schramm ..... 422/82.05
5,262,128 A * 11/1993 Leighton et al. ..... 422/100
5,290,521 A * 3/1994 DeStefano, Jr. ..... 422/99
5,415,060 A * 5/1995 DeStefano, Jr. ..... 74/540
5,842,582 A * 12/1998 DeStefano, Jr. ..... 211/60.1
6,135,406 A * 10/2000 DeStefano, Jr. ..... 248/309.1
6,231,813 B1 * 5/2001 Ally et al. ..... 422/100
6,921,513 B2 * 7/2005 Schubert et al. ..... 422/100
6,943,009 B2 * 9/2005 Lacey et al. ..... 435/297.5
2004/0087005 A1 * 5/2004 Henderson et al. ..... 435/283.1

OTHER PUBLICATIONS

U.S. Appl. No. 10/890,760, filed Jul. 14, 2004, Locklear et al.

* cited by examiner

*Primary Examiner*—Jill Warden
*Assistant Examiner*—Shogo Sasaki

(57) ABSTRACT

A pipette guide for a standard well plate provides improvements over conventional guides. The improvements include: reference characters to signify a columns of wells exposed, an aperture for viewing those characters, a angled slot and open ended isolator for improved ergonomic function and visibility, a multilevel slide to help prevent contamination and a bi-directional selection assembly for selecting a 96 or 384 well plate.

3 Claims, 4 Drawing Sheets

PIPETTE GUIDE

FIELD OF THE INVENTION

The invention herein pertains to a laboratory device for precisely transferring liquids into standard well plates using conventional single or multichannel manual or electronic pipettes.

DESCRIPTION OF THE PRIOR ART AND OBJECTIVES OF THE INVENTION

Well plates or microtiter plates have taken the place of test tubes in many laboratories. Well plates are relatively inexpensive, require comparatively small sample sizes, are easy to dispose of, come in standard sizes and materials, and save precious laboratory time and resources by allowing simultaneous analysis of multiple samples. Due to their widespread use, many standard protocols are specifically designed to be performed in well plates. In addition, there are many devices which facilitate the use of well plates, such as pipettes, in particular multi-channel pipettes, reagent reservoirs, plate readers and plate reader data analysis programs.

Laboratory personnel must be properly trained in well plate analytical techniques for accurate, reliable and reproducible results. However, even skilled operators become distracted, confused or careless and make mistakes. Errors primarily arise when a sample is introduced into the wrong well, or column or row of wells, or when the incorrect volume of sample is introduced.

The possibility of operator error in using well plates is known. However, there are various methods and devices which assist lab workers. Of particular relevance is a conventional pipetting guide which is disclosed in U.S. patent application Ser. No. 10/890,760 referred to herein. This conventional pipetting guide provides: a frame-like cover which fits over the well plate so that the wells are exposed through an open portion, a lock which secures the well plate to the cover, a slide which travels along the longitudinal axis of the cover and well plate, and a slot in the slide which exposes individual columns of wells for operator manipulation. This conventional guide also provides a side rod attached adjacent to the upper horizontal portion of the cover, and a lateral slide rod which is attached to the slide alongside the slot and perpendicular to the side rod. The slide is slidably engaged with the side rod, thereby allowing horizontal motion of the slide. A single well isolator is slidably engaged with the lateral slide rod, thereby allowing a specific well in the column exposed by the slot to be selected and manipulated.

Although the conventional pipette guide is very useful, it has its shortcomings. Specifically, the conventional pipetting guide does not allow the operator to readily identify the column of wells which are exposed for manipulation, the isolator port and slot are cumbersome, there is a gap between the slide plate and wells which could facilitate incorrect pipetting or contamination, and the mechanism for setting the plate type (96 versus 384 well) on the lateral slide rod is easily set incorrectly.

Thus, with the problems and disadvantages of using no pipetting guide, or even a conventional pipetting guide, the present invention was conceived, and one of its objectives is to provide a pipette guide which will ensure more accurate, precise and reliable well plate manipulations.

Another objective of the present invention is to provide a pipette guide which allows the operator to identify the column and row of the well into which they are pipetting by providing reference characters.

Another objective of the present invention is to provide an isolator that reduces the likelihood of contaminating a pipetting sample by providing a biased and open-ended port which is less likely to be inadvertently touched by a pipette tip.

Still another objective of the present invention is to provide a pipetting guide with an angled slot to allow multi-directional loading of sample into a well plate, thereby increasing operator comfort and improving visibility.

Another objective of the present invention is to provide a multi-thickness slide plate which does not contact the well plate, but is in very close proximity thereto.

Yet another objective of the present invention is to provide rods which are easily and accurately adjusted according to whether a 96 or 384 well plate is being used, by employing dual position ridged shoulder/recessed lug mechanisms.

Various other objectives and advantages of the present invention will become apparent to those skilled in the art as a more detailed description is set forth below.

SUMMARY OF THE INVENTION

The aforesaid and other objectives are realized by providing a pipette guide and method of use as described herein. The pipette guide includes reference characters which identify the column of wells exposed by the slide plate. The rods of the device are manipulated to correspond with using either a 96 or 384 well plate. Upon setting the rods for the appropriate well plate, the corresponding reference characters are displayed and the proper notches are engaged with the slide plate and isolator, thereby allowing the guide to precisely "click in" at desired positions on the well plate. The invention also facilitates multi-directional loading of wells by providing access to the wells through an angled slot on the sliding plate. Another improvement in the invention is a slide plate which is thinner on the outer edges than the inner portion. The multi-thickness slide plate improves the precision in delivering a sample, while still allowing sliding motion between the well plate, cover and slide. Another improvement of the invention is the single well isolator which provides access to the reservoir through a biased, open-ended aperture that adequately guides the pipette tip but reduces the risk of touching the aperture. Finally, a novel selection assembly is presented which allows the user to easily and precisely choose the type of plate which is to be used.

DETAILED DESCRIPTION OF THE PREFERRED EMBODIMENT AND OPERATION OF THE INVENTION

Figure 1:
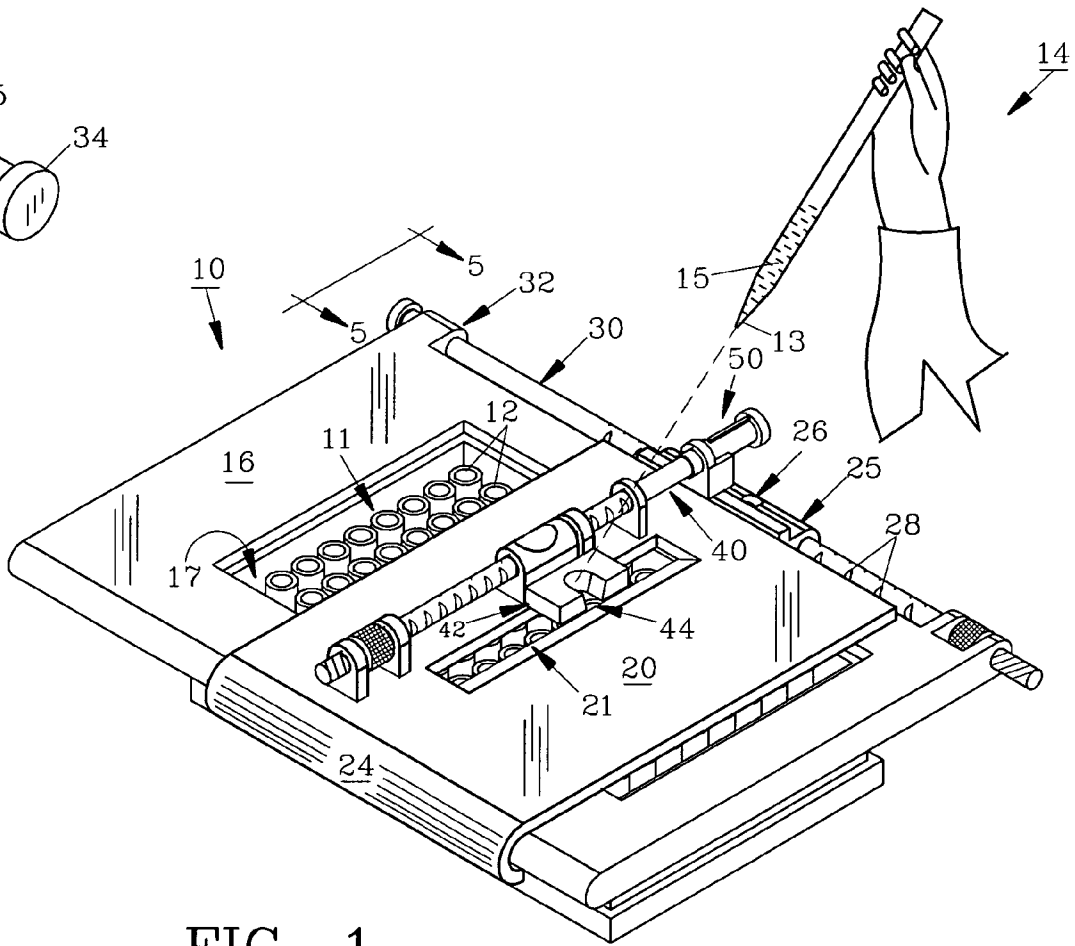
FIG. 1 shows a perspective view of the preferred form of the invention as positioned on a well plate.
Figure 2:
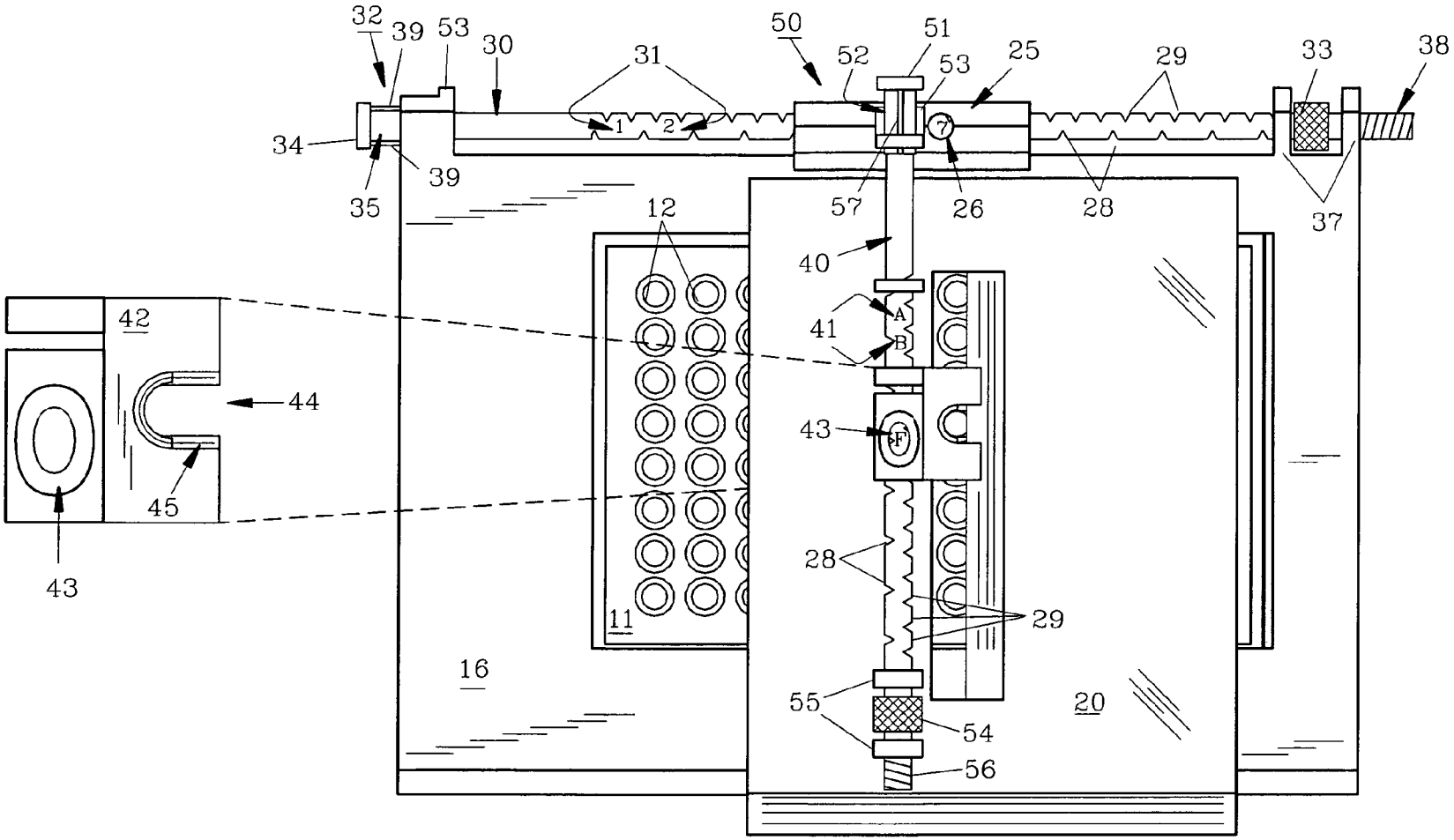
FIG. 2 illustrates a top view of the pipette guide of FIG. 1 with the isolator enlarged and exploded therefrom.

The major structural components of preferred pipette guide 10 include: cover 16 which fits over microtiter plate 11, slide 20 which defines angled slot 21, side rod 30 and lateral slide rod 40 with isolator 42, all shown in FIG. 1. Side rod 30 and lateral slide rod 40 are attached to cover 16 and slide 20 respectively (FIG. 2). Preferred components constituting the pipette guide improvement include: angled slot 21 (FIG. 3), thick portion 22 and thin portion 23 (FIG. 4), and column reference characters 31, flange aperture 26, isolator port 44, side rod adjuster 32 and lateral slide rod adjuster 50 as seen in FIG. 2.

Figure 4:
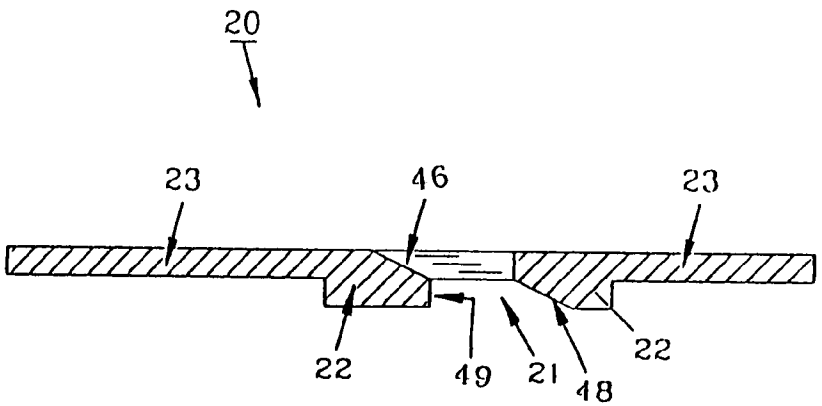
FIG. 4 demonstrates an enlarged cross sectional view of a portion of the slide as seen along reference lines 4-4 of FIG. 3.

Thick portions 22 as seen in FIG. 4 comprise opposing rimmed edges 22 on the bottom surface of slide 20 at the perimeter of slot 21 with acutely angled side wall 46 and obtusely angled side wall 48. As further seen in FIG. 4, opposing rimmed edges 22 define a slope with respect to the plane of slide 20. The acutely angled side wall 46 is truncated to provide a perpendicular rimmed edge 49 to increase visualization and liquid dispensing accuracy.

Figure 3:
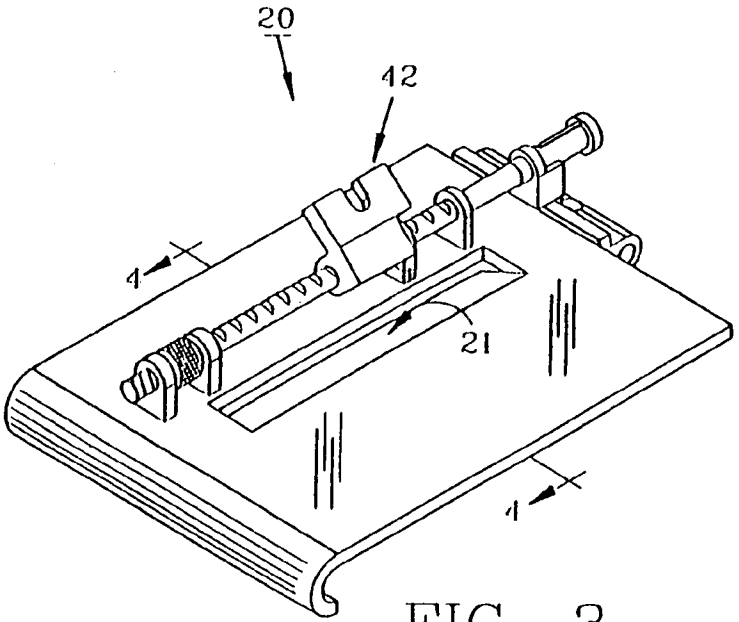
FIG. 3 depicts a perspective view of the preferred slide as removed from the pipette guide.
Figure 6:
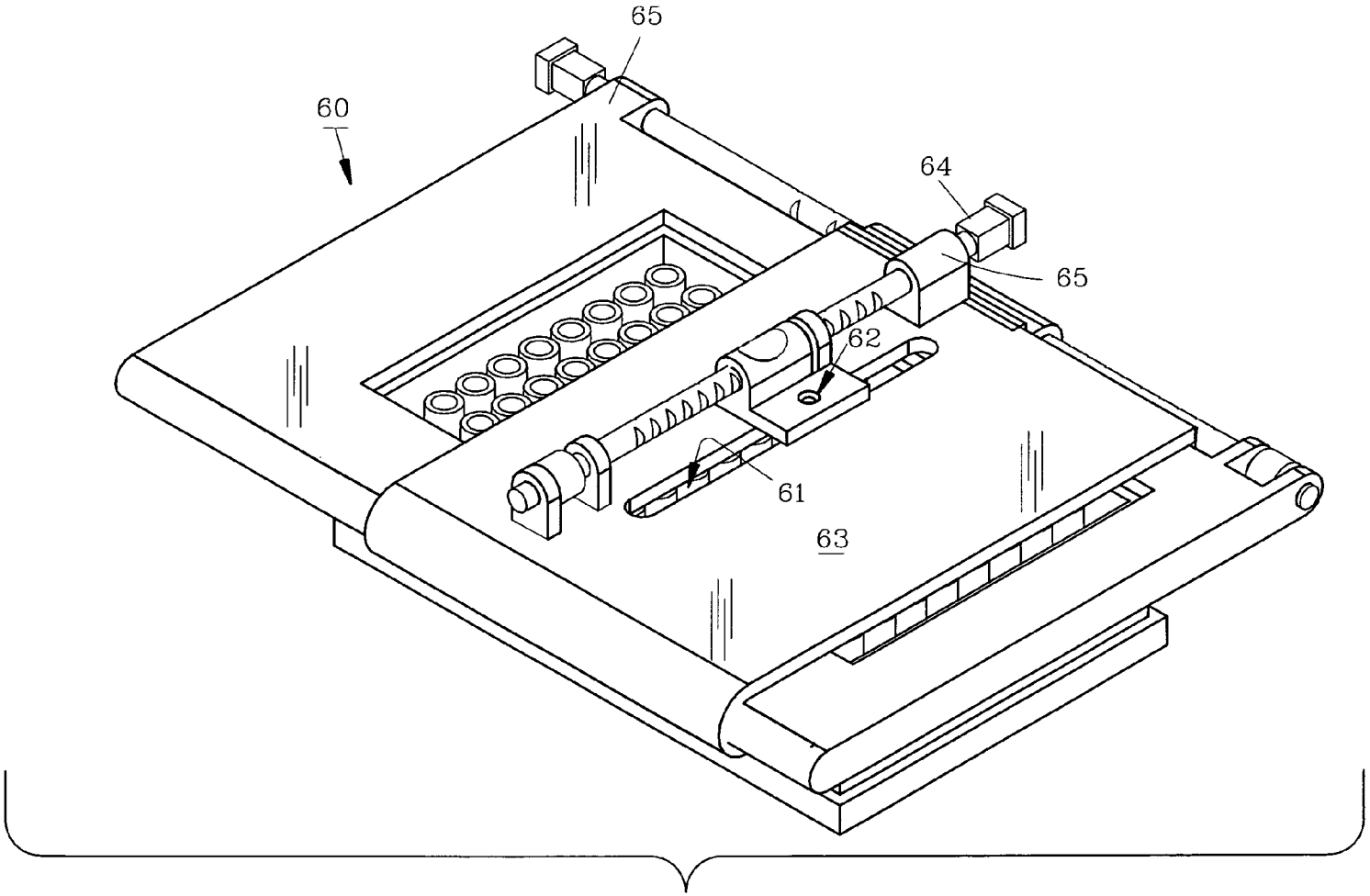
PRIOR ART FIG. 6
FIG. 6 shows a perspective view of a conventional pipette guide.

Angled slot 21 of FIGS. 3 and 4 allows user 14 to pipette into wells 12 from different directions. Conventional pipette guide 60 has slot 61 which is not angled and therefore requires vertical pipetting (FIG. 6). Angled slot 21 is advantageous because it allows user 14 to pipette either vertically or at an angle without contacting slide 20 with pipette tip 13. Angular pipetting is desirable because it is more ergonomically correct and provides better visualization for manipulation of sample liquid 15 into wells 12. Improved visibility increases precision and accuracy.

Multilevel slide 20 of pipette guide 10 is an improvement over conventional slide 63 which has uniform thickness (not shown). In FIG. 4, slide 20 includes thick portion 22 which defines angled slot 21, and thin portion 23. The advantage of thick portion 22 is less empty space between the underside of slide 20 and the openings of wells 12 (not shown). This lessens the likelihood that pipette tip 13 will be misdirected or sample liquid 15 will be inadvertently sprayed or otherwise deposited into the wrong well 12. Thin portion 23 allows slide 20 to freely move over cover 16. Thus, the combination of thick and thin portions 22 and 23 in slide 20 provide the advantages of increased precision and accuracy, while retaining easy movement between parts as in conventional slide 63.

Column reference characters 31 and flange aperture 26 of FIG. 2 collectively provide the improved feature of column identification in pipette guide 10. When slide 20 is moved along longitudinal axis (not shown) of cover 16, flange 25 "clicks" into notches 28 or 29, which respectively correspond with either 96 or 384 well plates. When "clicked in", slot 21 exposes a specific column of wells. (A standard 384 well plate contains 24 columns of 16 wells per column, a standard 96 well plate contains 12 columns of 8 wells per column.) The specific column of wells exposed by slot 21 is reflected as the column reference character 31 visible through flange aperture 26, as seen in FIG. 2 where "7" is displayed. Conventional pipette guide 60 does not identify columns of exposed wells.

It should be understood that FIG. 2 shows "1", "2" and "7" for column reference characters 31, but said characters actually go up sequentially to "12" or "24" depending on the plate type. Likewise, row reference characters 41 actually sequentially go from "A" to "H" or "P", not only "A", "B" and "F" as illustrated in FIG. 2.

Improved pipette guide 10 also differs from conventional pipette guide 60 insofar as the present invention provides open isolator port 44 having biased edges 45 (FIG. 2), as opposed to a closed isolator port 62 with edges that are not biased (FIG. 6). This improvement allows user 14 to accurately and precisely pipette into well 12, but with less risk of contacting the port. It is advantageous for user 14 to avoid touching port 44 with pipette tip 13 because contact can result in inadvertent discharge of sample liquid 15 or contamination. Port 44 also facilitates angled pipetting due to biased edge 45 and open port 44 (FIG. 2). Angled pipetting is advantageous for ergonomic and visibility reasons.

Another improvement in pipette guide 10 is the assemblies for selecting either 96 well or 384 well plates. These assemblies, lateral slide rod adjuster 50 and side rod adjuster 32, are present on the upper portion of lateral slide rod 40 and left portion of side rod 30, FIG. 2, respectively. For purposes of clarity, side rod adjuster 32 will be discussed in detail herein and is illustrated in detail in FIG. 5. However, it should be understood that lateral slide rod adjuster 50 and side rod adjuster 32 are analogous structures with analogous function, except the former adjusts for microtiter plate 11 rows via lateral slide rod 40, while the latter adjust for microtiter plate 11 columns via side rod 30. Specifically, side rod nut 33 is equivalent to lateral slide rod nut 54, side rod head 34 is equivalent to lateral slide rod head 51, side rod shoulder 35 is equivalent to lateral slide rod shoulder 52, side rod lug 36 is equivalent to lateral slide rod lug 53, side rod nut lugs 37 are equivalent to lateral slide rod nut lugs 55, side rod threads 38 are equivalent to lateral slide rod threads 56, side rod ridges 39 are equivalent to lateral slide rod ridges 57, and side rod lug recess 47 is equivalent to lateral slide rod recess (not shown).

Figure 5:
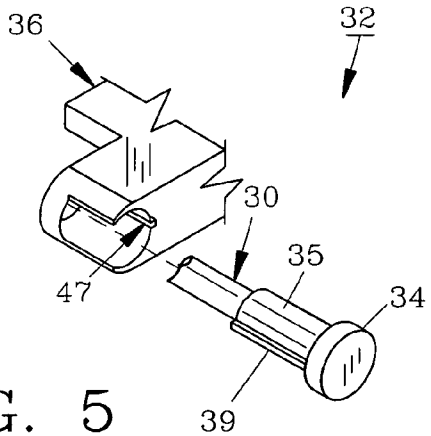
FIG. 5 pictures an enlarged and exploded perspective view of the side rod adjustor as seen along reference lines 5-5 of FIG. 1.

Side rod shoulder 35 contains two equally spaced side rod ridges 39 (only one ridge shown in FIG. 5). Thus, side rod shoulder 35 may fit into side rod lug recess 47 of side rod lug 36 in two possible positions; for a 96 well plate, or turned 180 degrees therefrom for a 384 well plate. This is an improvement over conventional pipette guide 60 (FIG. 6) which provides square lug 65 (square receiving portion not seen) which receives square shoulder 64. The conventional pipette guide allows four potential positions, each 90 degrees separate, only two of which correspond with a plate type. The other two are non-functional. With side rod adjuster 32 (or lateral slide rod adjuster 50), user 14 is less likely to inadvertently select an invalid or incorrect setting. Correctly setting the device is necessary so the proper set of opposing notches 28 or 29, corresponding with 96 well plates or 384 well plates respectively, are in contact with flange 25 or isolator 42. This allows the user to accurately "click" on columns of reservoirs and specific reservoirs within said column.

The preferred method of using pipette guide 10 is described below. For simplicity, the method of using pipette guide 10 on a 96 well plate is set forth. However, it should be understood that guide 10 may also be used on a 384 well plate. In the preferred method, user 14 first determines if pipette guide 10 is set for 96 well plate use by viewing reference characters 31 and 41. For 96 well plate use, only the numbers 1 through 12 should be displayed as column reference characters 31, and row reference characters 41 should only be letters A through H. Ranges 1-24 and A-P correspond with 384 well plate use. If the requisite ranges for 96 well plate use are not shown, namely 1-12 and A-H, user 14 adjusts accordingly by using side rod adjuster 32 and lateral slide rod adjuster 50, located on side rod 30 and lateral slide rod 40 respectively.

For simplicity, the method of adjusting side rod adjuster 32 will be set forth, however the same steps would apply to adjusting lateral slide rod adjuster 50 using analogous parts set forth above. To adjust side rod 30, user 14 turns side rod nut 33 so side rod 30 is urged away from side rod nut lugs 37 due to force on side rod threads 38 (FIG. 2). Once side rod shoulder 35 has cleared side rod lug 36 (FIG. 5), the user sets proper position of side rod 30 by turning side rod head 34 so desired column reference characters 31 are easily viewable. When side rod 30 is properly set, user 14 turns side rod nut 33 in opposite direction to urge side rod shoulder 35 back into side rod lug 36, with one of side rod ridges 39 engaging side rod lug recess 47.

Once pipette guide 10 is properly set for a standard 96 well microtiter plate, microtiter plate 11 is placed under cover 16 of pipette guide 10 so microtiter plate 11 is exposed through window 17. Slidable lock (not shown) on underside of cover 16 is urged sidewardly to secure microtiter plate 11 to cover 16. User 14 "fine-tunes" the adjustment by rotating side rod nut 33 and lateral slide rod nut 54 so reference characters 31 and 41 are centered in and easily seen through flange aperture 26 and isolator aperture 43 respectively.

User 14 urges slide 20 along cover 16 until the desired column of wells are exposed through angled slot 21. If sample liquid 15 is to be added using a single pipette, isolator 42 should be engaged as depicted in FIG. 1. Alternatively, if a multichannel pipette is used, isolator 42 may be rotated upwardly so slot 21 is unimpeded, as in FIG. 3. User 14 verifies that the desired column is exposed by viewing column reference character 31 through flange aperture 26 as seen in FIG. 2 as "7". If a single pipette is used, the user verifies that the row location of desired well 12 is correct by viewing row reference character 41 in isolator aperture 43, as seen in FIG. 2 as "F". Assuming the proper column or specific well is selected, user 14 proceeds with adding sample liquid 15, or otherwise manipulating the well contents as normal, except pipette tip 13 manipulates through the angled slot 21 or isolator 42 (and angled slot 21). Preferably, pipette tip 13 does not touch angled slot 21 or isolator 42.

User 14 urges slide 20 and isolator 42 as necessary to expose wells 12 for manipulation, and performs desired manipulations until microtiter plate 11 is properly prepared. If user 14 wishes to manipulate sample liquid 15 without assistance of pipette guide 10, user 14 may simply disengage lip 24 from cover 16 and rotate the entire slide 20 upwardly and away from microtiter plate 11. When microtiter plate 11 has been prepared as desired, user 14 urges slidable lock (not shown) on underside of cover 16 sidewardly to release microtiter plate 11 from cover 16. Microtiter plate 11 is then incubated or analyzed as normal.

The illustrations and examples provided herein are for explanatory purposes and are not intended to limit the scope of the claims.

I claim:

1. A guide device for a well plate comprising:

(a) a slide comprising an insertion slot for a tip of a liquid dispensing device;

said slot comprising opposing rimmed edges at the perimeter of its opening provided on the bottom surface of said slide;

said opposing rimmed edges comprising a pair of acutely angled and obtusely angled side walls, wherein said side walls defining a slope with respect to the plane of said slide;

said acutely angled side wall being truncated to provide a perpendicular rimmed edge to increase visualization and liquid dispensing accuracy;

(b) a flange, said flange attached to said slide, said flange defining an aperture;

(c) a side rod, said side rod comprising reference characters, said reference characters positioned on said side rod, said flange slidably engaging said side rod, said reference characters viewable through said aperture; and (d) a well plate cover, said well plate cover engaging said side rod.

2. The guide device of claim 1, further comprising:

a side rod shoulder, said side rod shoulder comprising a side rod ridge, said side rod ridge positioned on said side rod shoulder, said side rod shoulder attached to said side rod; and a side rod lug, said side rod lug attached to said well plate cover, said side rod lug defining a side rod lug recess, said side rod lug recess engaging said side rod ridge.

3. The guide device of claim 1, further comprising:

a lateral slide rod, said lateral slide rod affixed to said slide; and an isolator, said isolator positioned on said lateral slide rod, said isolator defining an open sided port.

* * * * *